US012270259B2

(12) United States Patent
Frost et al.

(10) Patent No.: US 12,270,259 B2
(45) Date of Patent: Apr. 8, 2025

(54) SNAKE-SKIN-INSPIRED IN-HOLE BOW SPRING CENTRALIZER

(71) Applicant: Georgia Tech Research Corporation, Atlanta, GA (US)

(72) Inventors: J. David Frost, Atlanta, GA (US); John A. Huntoon, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 18/668,487

(22) Filed: May 20, 2024

(65) Prior Publication Data

US 2024/0384608 A1 Nov. 21, 2024

Related U.S. Application Data

(60) Provisional application No. 63/467,504, filed on May 18, 2023.

(51) Int. Cl.
*E21B 17/10* (2006.01)

(52) U.S. Cl.
CPC ..... *E21B 17/1028* (2013.01)

(58) Field of Classification Search
CPC .. E21B 17/10; E21B 17/1078; E21B 17/1014; E21B 17/1021; E21B 17/1028
See application file for complete search history.

(56) References Cited

U.S. PATENT DOCUMENTS 1,350,655 A 10/1886 Brooder et al.
1,293,777 A 2/1919 Hogue
1,475,344 A 11/1923 Judson
1,708,277 A 4/1929 Martin
1,801,334 A * 4/1931 Dalldorf ..... E21B 31/20 175/325.2
1,835,377 A * 12/1931 Clark ..... E21B 33/12 166/241.1
2,220,237 A * 11/1940 Hall ..... G05G 1/10 15/104.095
2,515,149 A * 7/1950 Willhoit ..... E21B 17/1028 166/173

(Continued)

FOREIGN PATENT DOCUMENTS

EP 0297716 A1 1/1989
EP 1787006 B1 4/2008

(Continued)

*Primary Examiner* — Kipp C Wallace

(74) *Attorney, Agent, or Firm* — Meunier Carlin & Curfman LLC

(57) ABSTRACT

A centralizer device includes a body collar and a tail collar each extending circumferentially around a central axis to define a longitudinal channel. The central axis extends from an up-hole direction towards a downhole direction of the centralizer device. The centralizer device includes a body extending between the body collar and the tail collar. The body includes a first portion, a second portion, and a bow portion that extends radially outward from the central axis to define at least one apex. The body further defines at least one opening. The centralizer device may include a tail extending (i) longitudinally from the tail collar or the body collar and (ii) radially outward from the central axis, the tail comprising a tail tip at a distal end thereof.

19 Claims, 13 Drawing Sheets

(56) References Cited

U.S. PATENT DOCUMENTS 2,646,680 A * 7/1953 Steele ..... E21B 47/06 174/69
2,717,650 A * 9/1955 Hall, Sr. ..... E21B 17/1028 166/173
2,781,100 A * 2/1957 Pyle ..... E21B 37/02 166/173
2,944,608 A 7/1960 Rush
3,172,475 A 3/1965 Moore
3,237,696 A 3/1966 Hall
3,312,285 A 4/1967 Solum
3,356,147 A 12/1967 Wilfred
3,410,613 A 11/1968 Felix
3,555,689 A 1/1971 Cubberly, Jr.
3,556,042 A 1/1971 Laughlin
4,077,470 A 3/1978 Dane
4,194,561 A * 3/1980 Stokley ..... E21B 17/1021 166/162
4,247,225 A 1/1981 Chickini, Jr. et al.
4,360,292 A 11/1982 Keeler et al.
4,595,055 A 6/1986 Vannier
4,719,803 A * 1/1988 Capelle ..... E21B 49/006 73/784
5,358,039 A 10/1994 Fordham
5,377,752 A 1/1995 Farrara
6,102,118 A 8/2000 Moore
6,367,556 B1 4/2002 Moore
6,457,519 B1 10/2002 Buytaert
6,666,267 B1 12/2003 Charlton
6,679,325 B2 1/2004 Buytaert
6,915,856 B2 7/2005 Gentry et al.
6,997,254 B2 2/2006 Jenner
7,048,064 B1 5/2006 Smith
7,191,829 B2 3/2007 Bllom et al.
7,559,371 B2 7/2009 Lynde et al.
7,857,063 B2 12/2010 Thornton
8,061,447 B2 11/2011 Krueger
8,701,783 B2 4/2014 Buytaert et al.
8,820,417 B2 9/2014 Reid
8,919,437 B2 12/2014 Macleod
9,016,384 B2 4/2015 Xu et al.
9,057,230 B1 6/2015 Parsons
9,249,575 B2 2/2016 Hutchison et al.
9,341,032 B2 5/2016 Jewett
10,151,113 B2 12/2018 Agee
10,584,459 B2 3/2020 Agee
11,174,641 B2 * 11/2021 Agee ..... E02D 5/80
2010/0018698 A1 1/2010 Garner
2011/0079385 A1 4/2011 Linaker
2014/0008056 A1 * 1/2014 Fayo ..... E21B 17/1028 166/241.1

FOREIGN PATENT DOCUMENTS

EP 3523561 B1 7/2020
GB 2 402 411 A 12/2004
WO 2021202944 A1 10/2021
WO 2022232637 A1 11/2022

* cited by examiner

SNAKE-SKIN-INSPIRED IN-HOLE BOW SPRING CENTRALIZER

CROSS-REFERENCE TO RELATED APPLICATIONS

This application claims priority to U.S. Provisional Patent Application No. 63/467,504, filed May 18, 2023, which is incorporated herein by reference in its entirety.

GOVERNMENT LICENSE RIGHTS

This invention was made with government support under grant no. EEC-1449501 awarded by the National Science Foundation. The government has certain rights in the invention.

BACKGROUND

Mechanical centralizers are used in conjunction with in-ground drilled holes in the underground drilling and geotechnical construction industries. Their role is to ensure that fluids, grouts or other cementitious materials are evenly distributed around a central object. Extant centralizers are one type of centralizer that is mechanically fixed to the object being centralized, typically a drilling stem, hole casing, pipe, or reinforcing element. Extant centralizers may use a mechanical linkage system to either release spring tension or apply stress to some portion of the centralizer to maintain its longitudinal hole position.

There is nevertheless a benefit to improving the designs and configurations of centralizers.

SUMMARY

An exemplary in-ground bow spring centralizer device, system, and method of use thereof are disclosed that, once placed in an underground drilled hole, is configured to provide spring tension to resist translation of the centralizer along the axis of that drilled hole, absent external mechanical effort, by applying stress to the exterior walls of the hole and/or penetrating into the soil surrounding the drilled hole. The resistance to translation is especially pronounced opposite the installation direction as a result of the snake-skin-inspired directionally varying surface of the centralizer. This allows the centralizer to remain longitudinally in place without a mechanical connection to the object being centralized, enabling sliding and rotational translation of the centralized object within the centralizer while the latter remains in place.

According to one aspect of the disclosure, an in-ground mechanical bow spring centralizer device is disclosed (e.g., for locating within a drilled hole, or guiding the installation of a tube or tendon in a drilled hole). The centralizer device includes a body collar, a tail collar, a body, and a tail. The body collar extends circumferentially around a central axis and defines a longitudinal channel. The central axis extends from an up-hole direction of the centralizer device towards a downhole direction of the centralizer device. The tail collar extends circumferentially around the central axis to further define the longitudinal channel. The tail collar is spaced apart from the body collar in the up-hole direction of the centralizer device. The body extends between the body collar and the tail collar. The body includes a first portion coupled to the body collar, a second portion coupled to the tail collar, and a bow portion coupled to and between the first portion and the second portion. The bow portion extends radially outward from the central axis to define at least one apex. The body further defines at least one opening. The tail extends (i) longitudinally from the tail collar or the body collar and (ii) radially outward from the central axis. The tail includes a tail tip at a distal end thereof.

In some implementations, the tail extends longitudinally from the tail collar in the up-hole direction. In some implementations, the tail tip extends further radially outward than the at least one apex of the bow portion of the body. In some implementations, the tail tip extends radially outward from the central axis the same distance as the at least one apex of the bow portion of the body extends radially outward from the central axis. In some implementations, the at least one apex of the bow portion of the body extends further radially outward than the tail tip.

In some implementations, the body includes a plurality of body sections, including a first body section and a second body section. In some implementations, the first body section and the second body section are equally circumferentially spaced apart from each other.

In some implementations, the tail includes a plurality of tail sections, including a first tail section and a second tail section that are equally circumferentially spaced apart from each other.

In some implementations, the body and the tail are flexible such that one or both of the body and the tail are radially compressible and expandable during operation.

In some implementations, the tail tip is angled such that (i) during movement of the centralizer device in the downhole direction of a hole (e.g., an insertion operation), the tail tip does not penetrate a surrounding substrate of the hole, and (ii) during movement of the centralizer device in the up-hole direction of the hole (e.g., an extraction operation), the tail tip penetrates the surrounding substrate to resist movement in the up-hole direction.

In some implementations the tail tip is flexible and, when penetrating the surrounding substrate, the tail tip flexes to move (i) radially outward from the central axis and (ii) longitudinally toward the downhole direction with respect to the tail collar.

In some implementations, the centralizer device is configured to allow longitudinal translation and rotational translation of a centralized object that is disposed within the longitudinal channel relative to the centralizer device.

According to another aspect, a system is disclosed, the system including an in-ground mechanical bow spring centralizer device and an installation tube. The in-ground mechanical bow spring centralizer device includes: a body collar extending circumferentially around a central axis and defining a longitudinal channel, the central axis extending from an up-hole direction of the centralizer device towards a downhole direction of the centralizer device; a tail collar extending circumferentially around the central axis to further define the longitudinal channel, the tail collar spaced apart from the body collar in the up-hole direction of the centralizer device; a body extending between the body collar and the tail collar, the body including a first portion coupled to the body collar, a second portion coupled to the tail collar, and a bow portion coupled to and between the first portion and the second portion, the bow portion extending radially outward from the central axis to define at least one apex, wherein the body further defines at least one opening; and a tail extending (i) longitudinally from the tail collar and (ii) radially outward from the central axis, the tail including a tail tip at a distal end thereof. The installation tube includes an outer tube surface and a catch disposed on and protruding from the outer tube surface, wherein the catch engages with one or both of the body collar and the tail collar.

In some implementations, the catch is a first catch, the installation tube further including a second catch spaced apart from the first catch. In some implementations, the first catch engages with the up-hole end of the tail collar through a tail opening defined by the tail, and the second catch extends through the at least one opening of the body to engage with the up-hole end of the body collar.

In some implementations, in an advancing configuration, an extent of the second catch engaging the body collar is disposed outside of the longitudinal channel and the installation tube is disposed inside the longitudinal channel radially adjacent to either the tail collar, the body collar, or the body. In some implementations, in a retracting configuration, the second catch is disposed inside the longitudinal channel and does not contact nor engage with the tail collar, the body collar, or the body, wherein the installation tube is free to retract out of the centralizer device.

In some implementations, the installation tube is disposed within the longitudinal channel of the centralizer device, and both the centralizer device and the installation tube are installed in an underground hole. In some implementations, the centralizer device is configured to use spring tension to resist deviation from an axis of the underground hole by applying stress to an exterior wall of the underground hole and/or penetrating a substrate of the underground hole. In some implementations, the catch of the installation tube engaging with the centralizer device applies a downhole force to the centralizer device to facilitate installation.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

Figure 1A:
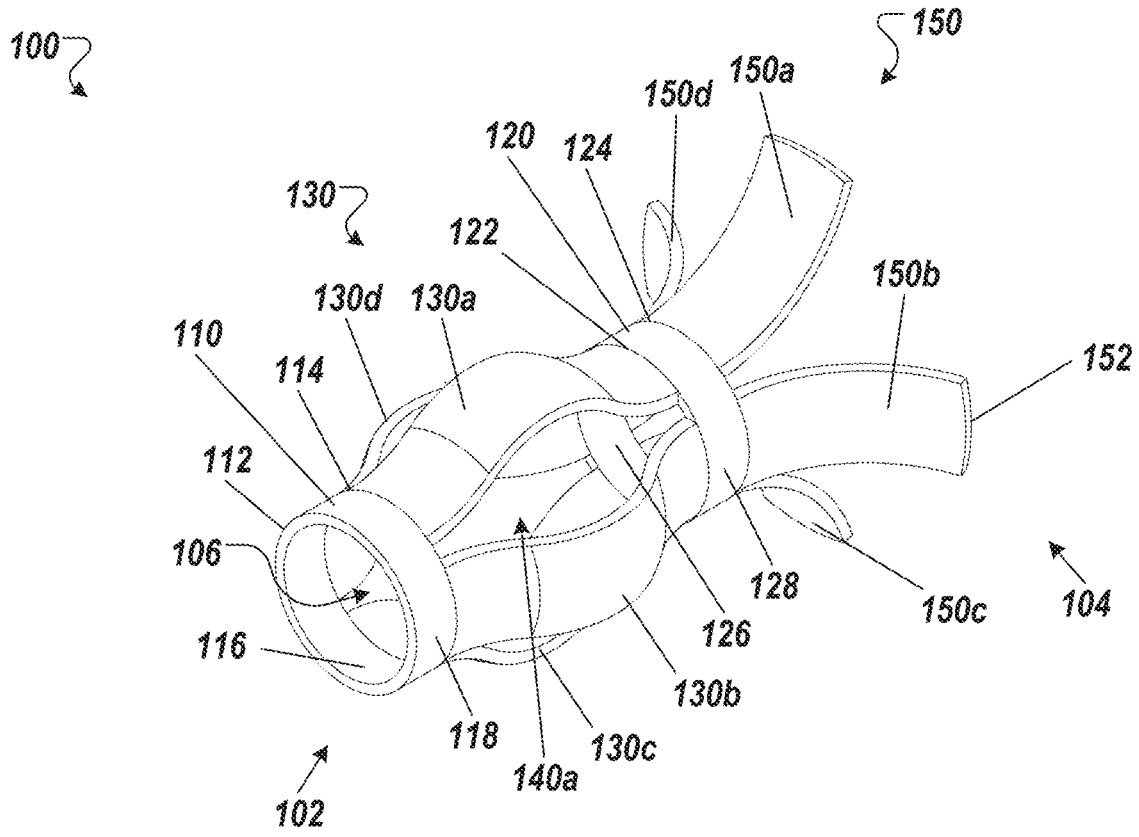
FIG. 1A shows an isometric view of an in-ground mechanical bow spring centralizer device, according to one implementation.

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Referring generally to the figures, an in-ground mechanical bow spring centralizer is shown, according to various implementations. Disclosed herein are various implementations of an in-ground mechanical bow spring centralizer which, once placed in an underground drilled hole, uses the spring tension and geometry of its partial bow section to resist translation along the axis of that hole absent external mechanical effort by applying stress to the exterior walls of the hole and/or penetrating into the soil surrounding the drilled hole. The resistance to translation is especially pronounced opposite the installation direction. This allows the centralizer to remain in place without a mechanical connection to the object being centralized, enabling sliding and rotational translation of the centralized object within the centralizer while the latter remains in place.

Figure 1B:
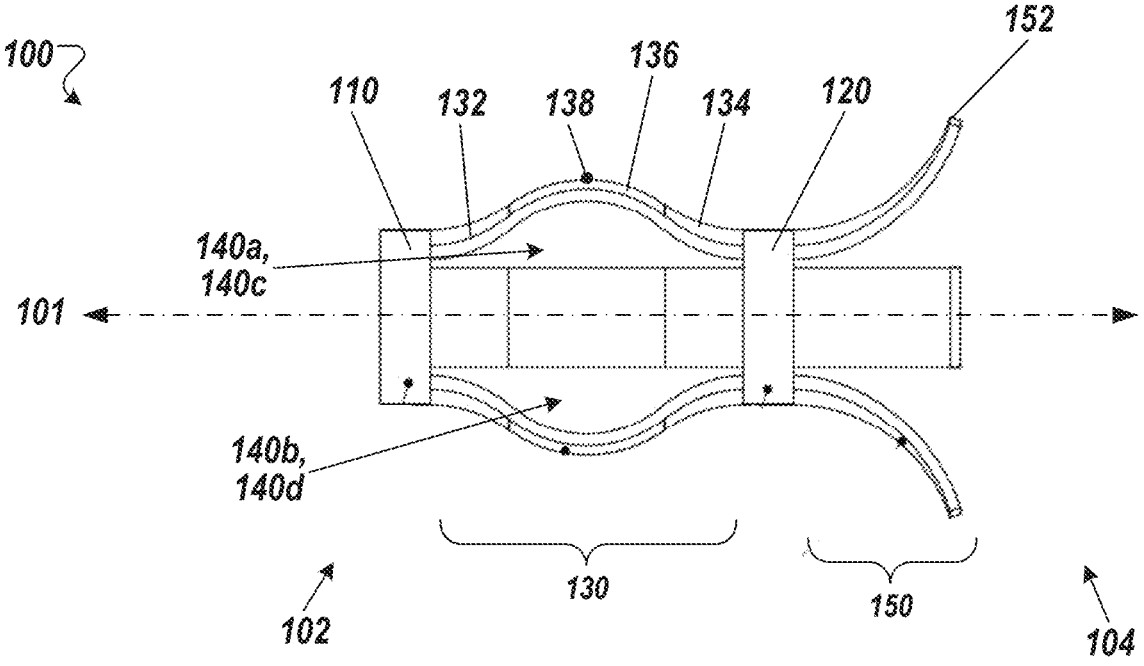
FIG. 1B shows a side view of the centralizer device of FIG. 1A.

FIG. 1A shows an isometric view of an in-ground mechanical bow spring centralizer device 100, according to one implementation. FIG. 1B shows a side view of the centralizer device 100 of FIG. 1A. The centralizer device 100 includes a first end 102 and a second end 104 opposite and spaced apart from the first end 102 along a central axis 101 of the centralizer device 100. In some implementations, the first end is a downhole direction, and the second end is an up-hole direction. For example, the centralizer device 100 may be used for guiding the installation of a tube or tendon in a drilled hole, or for locating an object within a drilled hole.

The centralizer device 100 includes a body collar 110, a tail collar 120, a body 130, and a tail 150. The body collar 110 extends circumferentially around the central axis 101. The body collar 110 includes a first end 112 and a second end 114 opposite and spaced apart from the first end 112. The body collar 110 further includes an inner surface 116 and an outer surface 118 opposite from the inner surface 116. Each of the inner surface 116 and the outer surface 118 extend between the first end 112 and the second end 114 of the body collar 110.

The inner surface 116 of the body collar 110 defines a portion of a longitudinal channel 106. The longitudinal channel 106 extends from near the first end 102 of the centralizer device 100 towards the second end 104 of the centralizer device 100 along the central axis 101.

The tail collar 120 extends circumferentially around the central axis 101. The tail collar 120 includes a first end 122 and a second end 124 opposite and spaced apart from the first end 122. The tail collar 120 further includes an inner surface 126 and an outer surface 128 opposite from the inner surface 126. Each of the inner surface 126 and the outer surface 128 extend between the first end 122 and the second end 124 of the tail collar 120. The inner surface 126 of the tail collar 120 further defines a portion of the longitudinal channel 106.

The body 130 extends between the body collar 110 and the tail collar 120. The body 130 includes a first portion 132 coupled to the body collar 110, a second portion 134 coupled to the tail collar 120, and a bow portion 136 coupled to and extending between the first portion 132 and the second portion 134. Specifically, the first portion 132 is coupled to and extends from the second end 114 of the body collar 110, and the second portion 134 is coupled to and extends from the first end 122 of the tail collar 120. In some implementations, the first portion, second portion, and bow portion are integrally formed with each other and/or with the body collar and the tail collar.

The bow portion 136 extends radially outward from the central axis 101 to define at least one apex 138. As shown in FIG. 1B, the bow portion 136 includes at least one apex 138 centralized between, or equally spaced in the middle of, the body collar 110 and the tail collar 120. However, in other implementations, the at least one apex 138 may be closer to either the tail collar or body collar. In other implementations, more than one apex is present on a single bow portion.

As shown, the first portion 132 extends away from the body collar 110 both longitudinally towards the tail collar 120 and radially outward from the central axis 101. Similarly, the second portion 134 extends away from the tail collar 120 both longitudinally towards the body collar 110 and radially outward from the central axis 101. Thus, while the bow portion 136 is disposed radially outward from each of the body collar 110, the tail collar 120, and the first portion 132 and the second portion 134 of the body 130, the first and second portions 132, 134 may also have curvature radially outward.

The body 130 shown in FIGS. 1A and 1B includes four body sections 130*a*, 130*b*, 130*c*, and 130*d*, each substantially similar to each other. However, in other implementations, the centralizer device 100 may include a single body section, two body sections, three body sections, or a plurality of body sections greater than four (e.g., 5, 6, 7, 8, 9, 10, 20, 30, 40, or 50 body sections). The body sections 130*a*-130*d* are equally circumferentially spaced apart from each other. However, in other implementations, the body sections may be spaced apart unevenly or in a pattern.

The body 130 shown in FIGS. 1A and 1B defines four openings 140*a*, 140*b*, 140*c*, and 140*d*, each substantially similar to each other. The openings 140*a*-140*d* are defined by the adjacent body sections 130*a*-130*d*. For example, opening 140*a* is defined by the body section 130*a* and the body section 130*b*. In other implementations, the centralizer device 100 may include a single opening, two openings, three openings, or a plurality of body openings greater than four (e.g., 5, 6, 7, 8, 9, 10, 20, 30, 40, or 50 body openings). In other implementations, the number of openings is not related to the number of body sections.

Each opening 140*a*-140*d* extends between adjacent body sections 130*a*-130*d* and between the body collar 110 and the tail collar 120. Thus, the body collar 110 and the tail collar 120 define the longitudinal margins of the openings 140*a*-140*d*.

The tail 150 extends from the second end 124 of the tail collar 120, away from the body collar 110 (e.g., in the up-hole direction). Specifically, the tail 150 extends longitudinally from the tail collar 120 and radially outward from the central axis 101. The tail 150 terminates in a tail tip 152 on a distal end of the tail 150. In other implementations, the tail 150 may be coupled to and extend from the body collar 110.

The tail 150 extends radially outward from the central axis 101 to define a tail diameter. In the centralizer device 100 in FIGS. 1A-1B, the tail diameter is greater than the body diameter defined by the distance radially outward that the at least one apex 138 of the bow portion 136 extends from the central axis 101. However, in other implementations, the tail diameter is equal to the body diameter. In other implementations, the tail diameter is less than the body diameter (e.g., as in FIG. 8A and FIG. 8B).

Similar to the body 130, the tail 150 includes four tail sections 150*a*, 150*b*, 150*c*, and 150*d*, each substantially similar to each other. However, in other implementations, the centralizer device 100 may include a single tail section, two tail sections, three tail sections, or a plurality of tail sections greater than four (e.g., 5, 6, 7, 8, 9, 10, 20, 30, 40, or 50 tail sections). The tail sections 150*a*-150*d* are equally circumferentially spaced apart from each other. However, in other implementations, the tail sections may be spaced apart unevenly or in a pattern.

In use, the centralizer device 100 may be installed in a hole (e.g., to locate or guide installation of a tube or tendon in a drilled hole). The body 130 and tail 150 are flexible such that one or both of the body and the tail are radially compressible (e.g., to a smaller body diameter and/or tail diameter) and expandable during operation or installation. In other implementations, one or more of the body and the tail are rigid, non-flexible structures which maintain their respective diameters.

Figure 2A:
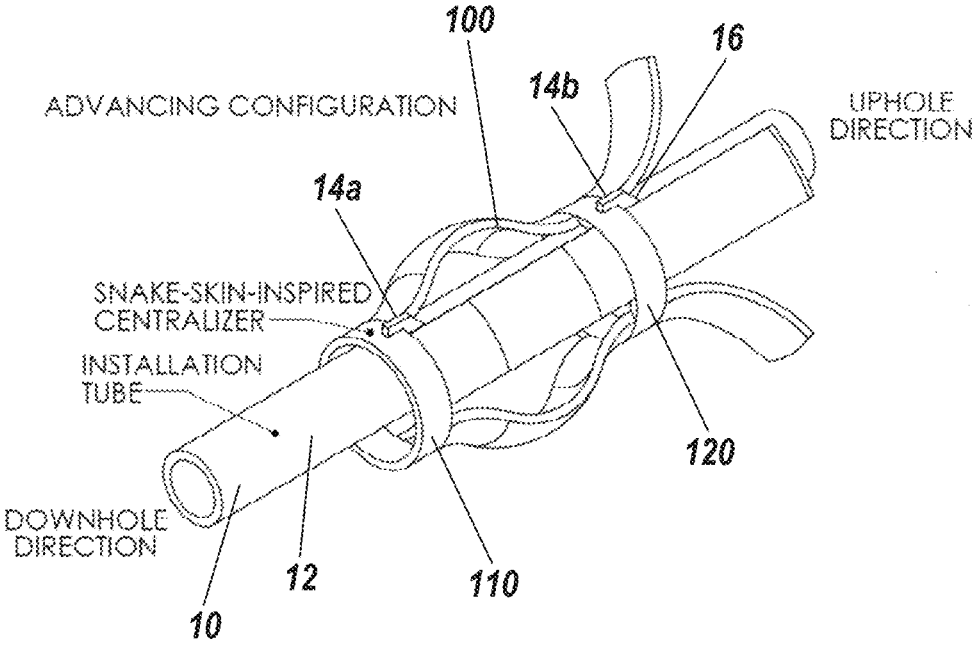
FIG. 2A shows an isometric view of a system including an installation tube disposed within the longitudinal channel of the centralizer device, according to one implementation.
Figure 2B:
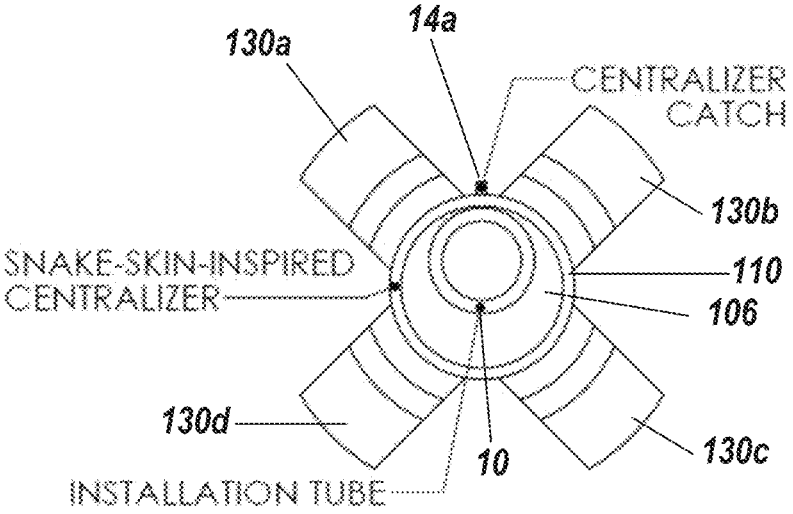
FIG. 2B shows a front view of the system of FIG. 2A.
Figure 3A:
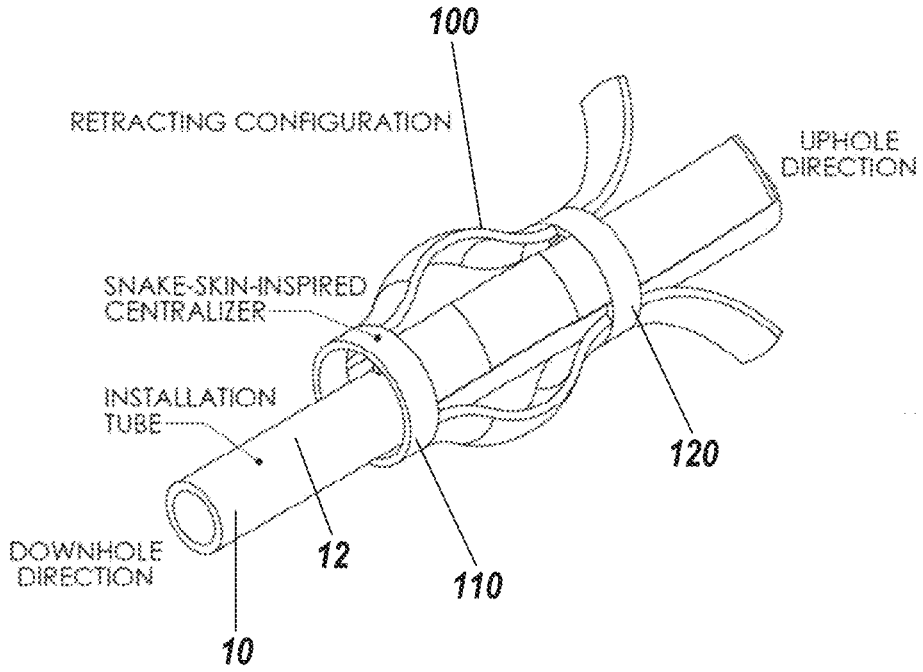
FIG. 3A shows an isometric view of the system of FIGS. 2A-2B in the retracting configuration, according to one implementation.
Figure 3B:
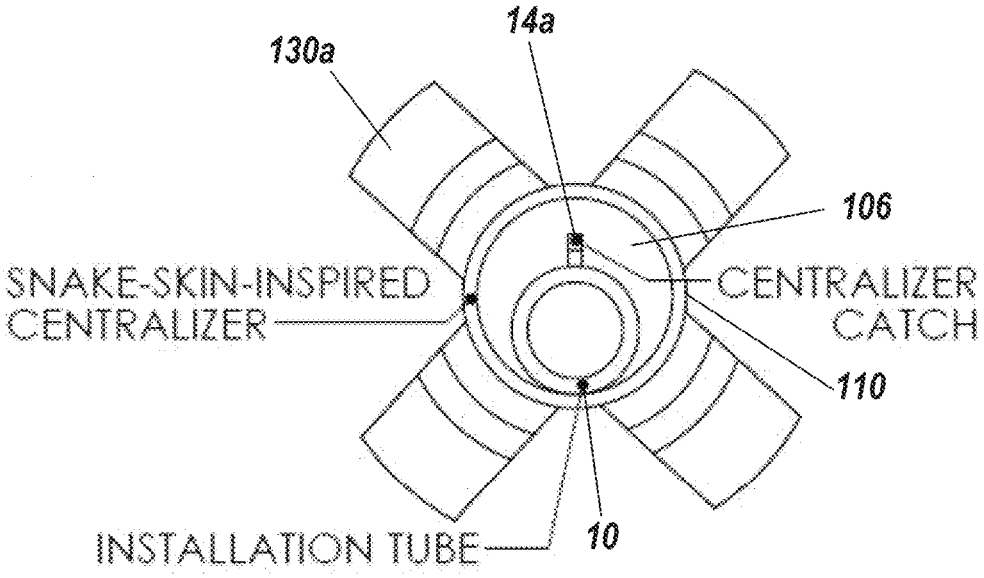
FIG. 3B shows a front view of the system of FIG. 3A.

FIG. 2A shows an isometric view of a system including an installation tube 10 disposed within the longitudinal channel 106 of the centralizer device 100. FIG. 2B shows a front view of the system of FIG. 2A. The system in FIG. 2A and FIG. 2B shows the system in the advancing configuration (i.e., wherein the installation tube 10 and the centralizer device 100 are engaged with each other and pushed into a hole in the downhole direction). FIG. 3A and FIG. 3B show the system of FIGS. 2A-2B in the retracting configuration (i.e., wherein the installation tube 10 is disengaged from the centralizer device 100 such that one moves axially with respect to the other). The centralizer device 100 is configured to allow longitudinal translation and rotational translation of the installation tube 10 (or any other centralized object) disposed within the longitudinal channel 106 relative to the centralizer device 100.

The installation tube 10 includes an outer tube surface 12 and a catch 14 disposed on and protruding from the outer tube surface 12. The catch 14 is configured to engage with either the body collar 110 or the tail collar 120 (or both) of the centralizer device 100. As shown in FIG. 2A, the installation tube 10 includes a first catch 14*a* and a second catch 14*b* that is proximally disposed relative to the first catch 14*a* (i.e., further in the up-hole direction). The first catch 14*a* engages the second end 114 of the body collar 110 through the opening 140*a*. The second catch 14*b* engages the second end 124 of the tail collar 120 in between adjacent tail sections 150*a*, 150*b* (e.g., through a tail opening).

Figure 4:
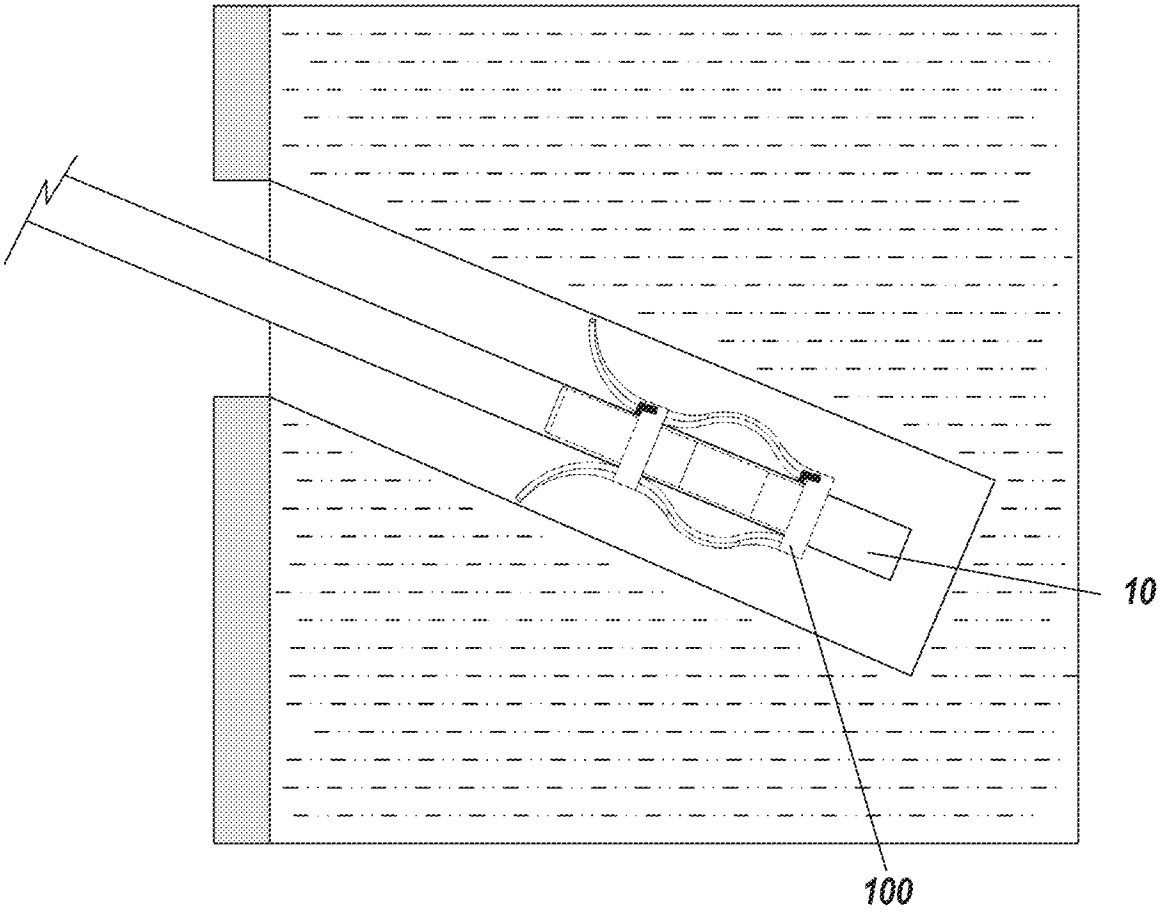
FIG. 4 shows the installation tube and the centralizer device inserted into an underground hole surrounded by substrate, according to one implementation.

In the advancing configuration shown in FIG. 2A and FIG. 2B, an extent of the first catch 14*a* engaging the body collar 110 is disposed outside of the longitudinal channel 106, and the installation tube 10 is disposed inside the longitudinal channel 106 radially adjacent to the body collar 110. Similarly, an extent of the second catch 14*b* is disposed outside of the longitudinal channel 106. Thus, in the advancing configuration, the first and second catches 14*a*, 14*b* apply a downhole force on the centralizer device 100 to facilitate insertion into a hole (e.g., an underground hole). FIG. 4 shows the installation tube 10 and the centralizer device 100 inserted into an underground hole surrounded by substrate, according to one implementation.

In the retracting configuration shown in FIG. 3A and FIG. 3B, the first catch 14*a* is disposed inside the longitudinal channel 106 and does not contact nor engage with the body collar 110. The installation tube 10 is free to retract out of the longitudinal channel 106 of the centralizer device 100 in the retracting configuration. Additionally, a proximal end of each of the first catch 14*a* and the second catch 14*b* includes an angled surface 16 to facilitate removal of the installation tube 10.

Figure 5:
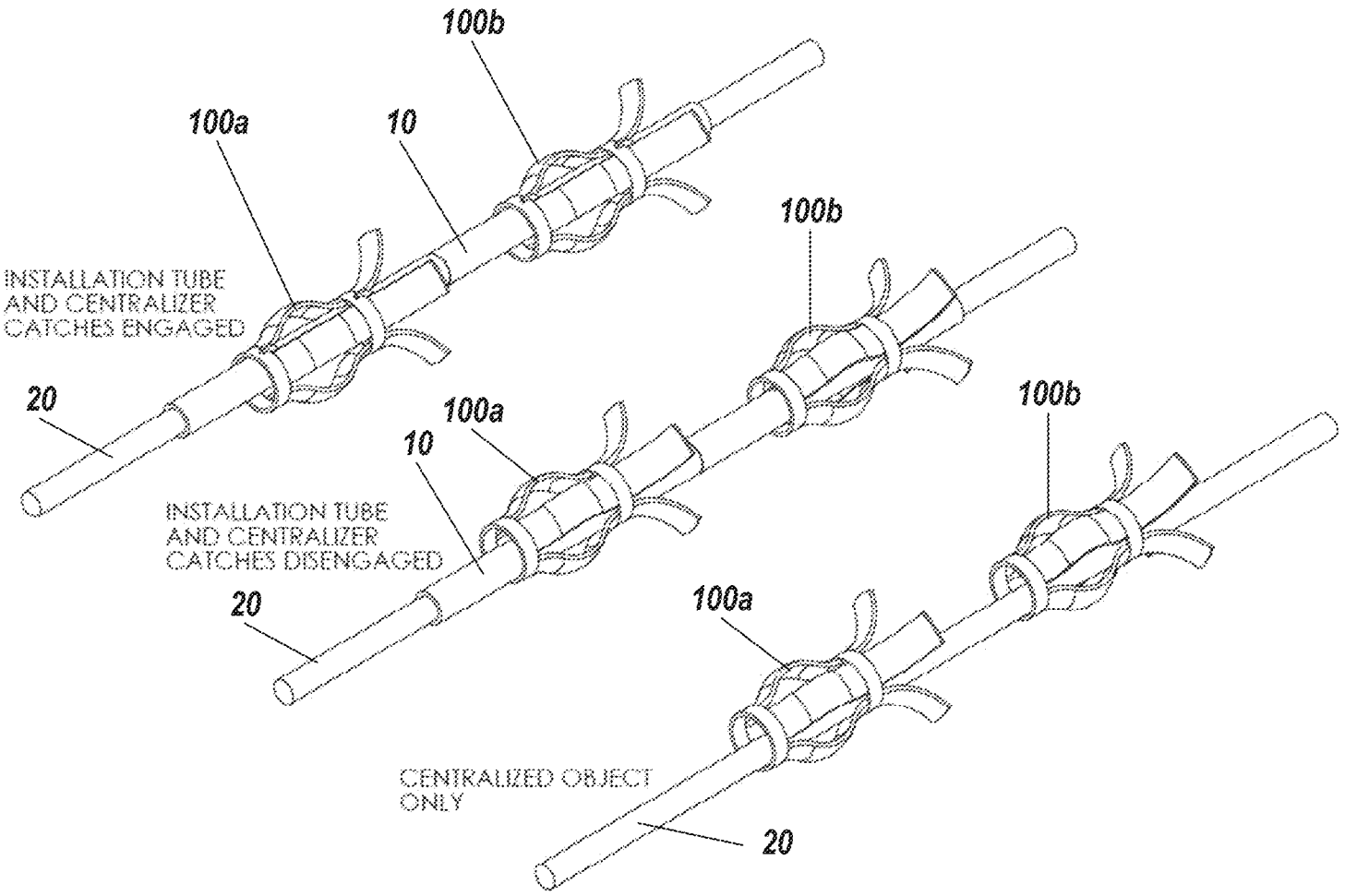
FIG. 5 shows the process of installing a centralized object using the installation tube and multiple centralized devices, according to one implementation.

FIG. 5 shows the process of installing a centralized object 20 using the installation tube 10 and multiple centralized devices 100*a* and 100*b*. While two centralization devices 100*a*, 100*b* are shown in FIG. 5, in other implementations the system may include only one centralization device of a plurality of centralization devices (e.g., 3, 4, 5, 6, 7, 8, 9, 10, 20, 30, 40, or 50 centralization devices.

In the first panel of FIG. 5, the centralization devices 100*a*, 100*b* are engaged with the installation tube 10 in the advancing configuration. The centralized object 20 moves axially (e.g., in the downhole direction) along with the installation tube 10 and the multiple centralized devices 100*a*, 100*b*. Then, in the second panel, the installation tube 10 disengages from the multiple centralized devices 100*a*, 100*b*. In the third panel, only the centralized object 20 is disposed within the multiple centralized devices 100*a*, 100*b*.

Figure 6A:
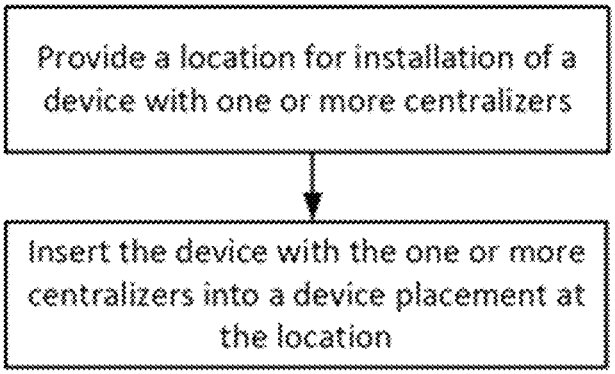
FIG. 6A is a flowchart showing one mode of placing a centralizer device around a tendon or member, according to one implementation.

FIG. 6A is a flowchart showing one mode of placing the centralizer devices of this disclosure (e.g., the centralizer device 100 of FIG. 1A) around a tendon or member, according to one implementation. For example, a location (e.g., a drilled hole) may be provided for the installation of a device having one or more centralizers pre-installed. Then, the device with the one or more centralizers is inserted into the location (e.g., the drilled hole).

Figure 6B:
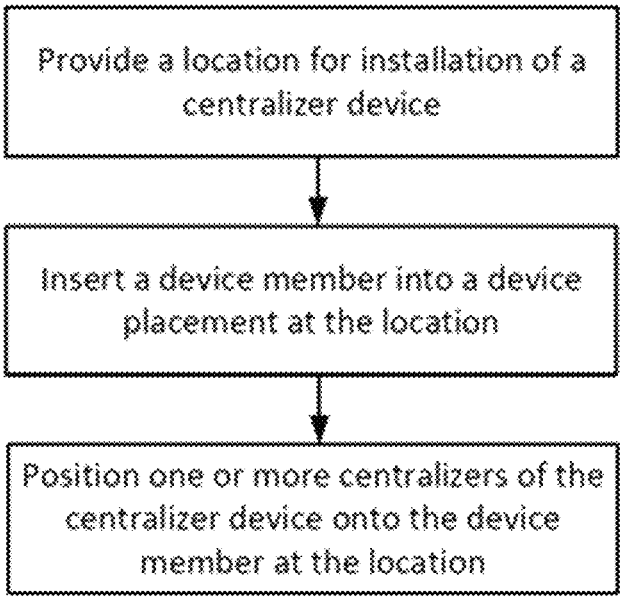
FIG. 6B is a flowchart showing one mode of placing a centralizer device around a tendon or member, according to one implementation.

FIG. 6B is a flowchart showing one mode of placing the centralizer devices (e.g., the centralizer device 100 of FIG. 1A) around a tendon or member, according to one implementation. For example, a location (e.g., a drilled hole) may be provided for the installation of a centralizer device and/or device member. A device member is then inserted into a centralizer device at the location. Then, one or more centralizer devices are placed onto the member as it is inserted into the location (e.g., placing the centralizer devices on the member one at a time as it is inserted into the hole).

The exemplary centralizer may be employed in various applications. One example is in a ground anchor. An example of a ground anchor system is described in PCT Publication Number WO 2021/202944 entitled "Ground Anchoring Apparatus and Method," which is hereby incorporated by reference in its entirety.

FIGS. 7A-7D show force diagrams of the tail tips of various implementations of the centralizer device. With reference to the centralizer device 100 of FIGS. 1A-1B, the tail tip 152 is angled such that, during movement of the centralizer device 100 in the downhole direction of a hole (e.g., an advancing configuration or an insertion condition), the tail tip 152 does not penetrate a surrounding substrate of the hole. Furthermore, the tail tip 152 is angled such that, during movement of the centralizer device 100 in the up-hole direction of the hole (e.g., a retracting configuration or an extraction condition), the tail tip 152 penetrates the surrounding substrate to resist movement in the up-hole direction.

Regarding the drilled holes and the surrounding substrate within which the centralizer device is installed: Passive or "Bearing" resistance of soil and rock is substantially higher and more reliably developed than frictional resistance, which can be quite low and is highly dependent on the exact condition of the interface between materials and presence of lubricants such as water, grouts, and drilling fluids. Thus, a centralizer which relies on passive resistance will be more reliable than one which relies on frictional resistance alone to prevent movement. Since centralizers are used to guarantee the position of an object within a hole, enhanced reliability is inherently valuable. Snakeskin inspired centralizers (e.g., those of this disclosure) develop little or no passive resistance during insertion but an amount sufficient to prevent movement of the centralizer during extraction of centralized objects.

In implementations wherein the tail tip 152 is flexible, when penetrating the surrounding substrate, the tail tip 152 flexes to move (i) radially outward from the central axis 101 and (ii) longitudinally toward the downhole direction with respect to the tail collar 120. In some implementations of the present disclosure, the "tail" of the centralizer device may be replaced by, or supplemented with, a "fin" or "fin array". For the purposes of the force diagrams of FIGS. 7A-7D, either the tail tip or a fin will function similarly.

Figure 7A:
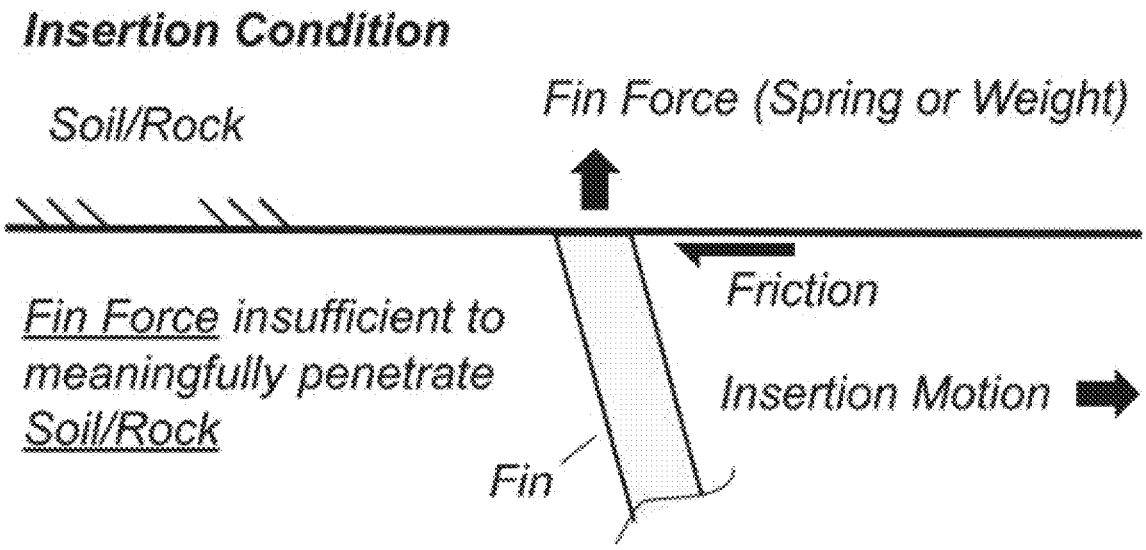
FIGS. 7A-7D each show a force diagram for a fin or tail tip of a centralizer device, according to various implementations.

FIG. 7A shows an insertion condition for a rigid or flexible fin (or tail tip) of a centralizer device. The fin moves in the direction denoted by the "insertion motion" arrow. A fin force is exerted on the wall or side of the hole with the soil and rock due to the spring force of the centralizer device, and/or a weight of the system. A friction force is thus generated between the fin and the wall of the hole. The fin force in the insertion condition is not sufficient to penetrate the surrounding substrate, at least not significantly.

Figure 7B:
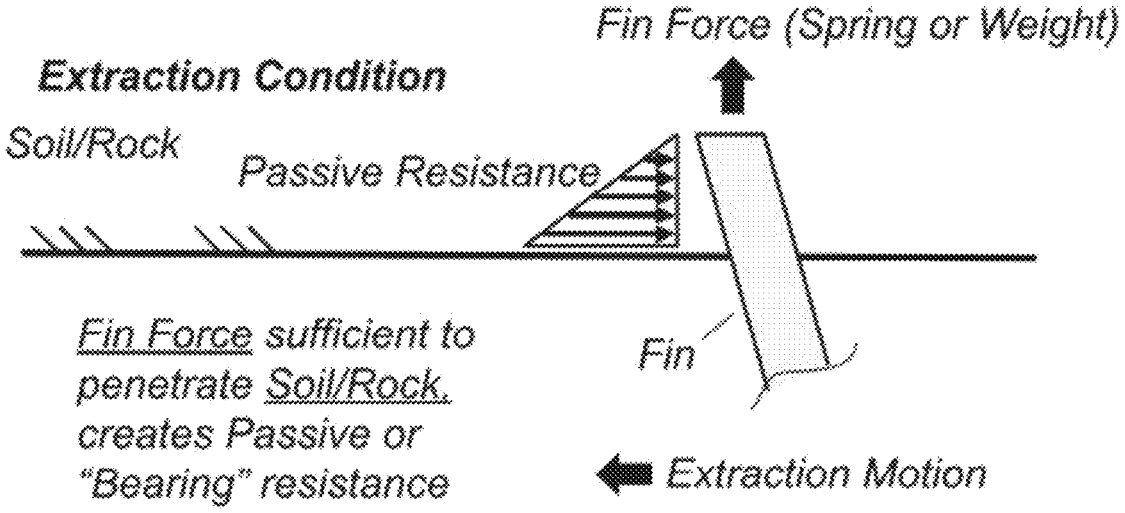

FIG. 7B shows an extraction condition for a rigid or flexible fin (or tail tip) of a centralizer device. The fin moves in the direction denoted by the "extraction motion" arrow. The fin force exerted on the wall of the hole is sufficient for the angled fin to penetrate the surrounding soil/rock substrate. The resulting passive or "bearing" resistance generated prevents removal of the centralizer device (or at least greatly increases the force required to remove the centralizer device).

Figure 7C:
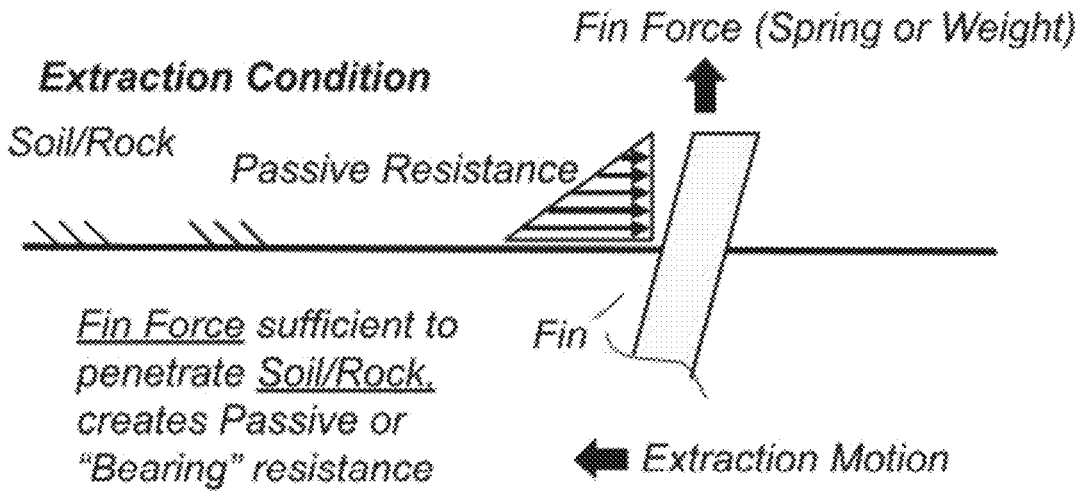

FIG. 7C shows an alternative extraction condition for a flexible fin (or tail tip) of a centralizer device. The fin moves in the direction denoted by the "extraction motion" arrow. The fin force exerted on the wall of the hole is sufficient for the angled fin to penetrate the surrounding soil/rock substrate. Additionally, the flexible fin flexes "backwards" with respect to the rest of the centralizer device as the centralizer device is extracted. Thus, the fin force increases due to the spring force of the fin. The resulting passive or "bearing" resistance generated prevents removal of the centralizer device (or at least greatly increases the force required to remove the centralizer device).

Figure 7D:
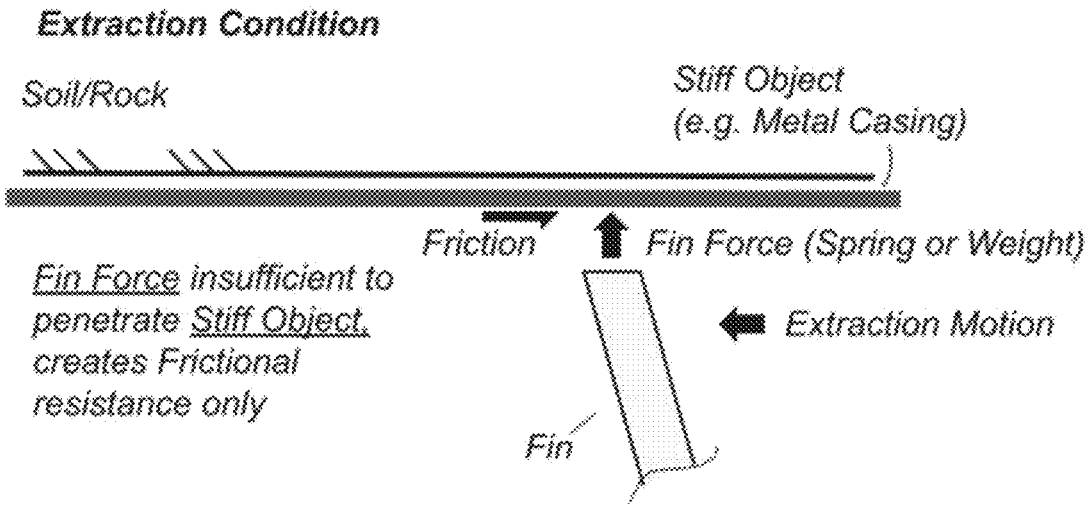

As a comparison, FIG. 7D shows an extraction condition for an existing centralizer device that is disposed within a stiff object (e.g., a metal drilling casing). The centralizer is generally unable, or not configured, to penetrate the walls of the stiff material surrounding it. The extraction condition of FIG. 7D shows the removal of a centralized object (e.g., an installation tube) from within the centralizer device. Resistance to the centralizer device moving relative to the centralized object is providing only by friction between the centralizer device and the stiff object (e.g., the metal casing). In contrast, the disclosed device shown in FIGS. 7A-7C can expand by mechanical action or pneumatic action to penetrate into the surrounding soil to provide another passive resistance with the surrounding soil.

Additional Example Devices

Figure 8A:
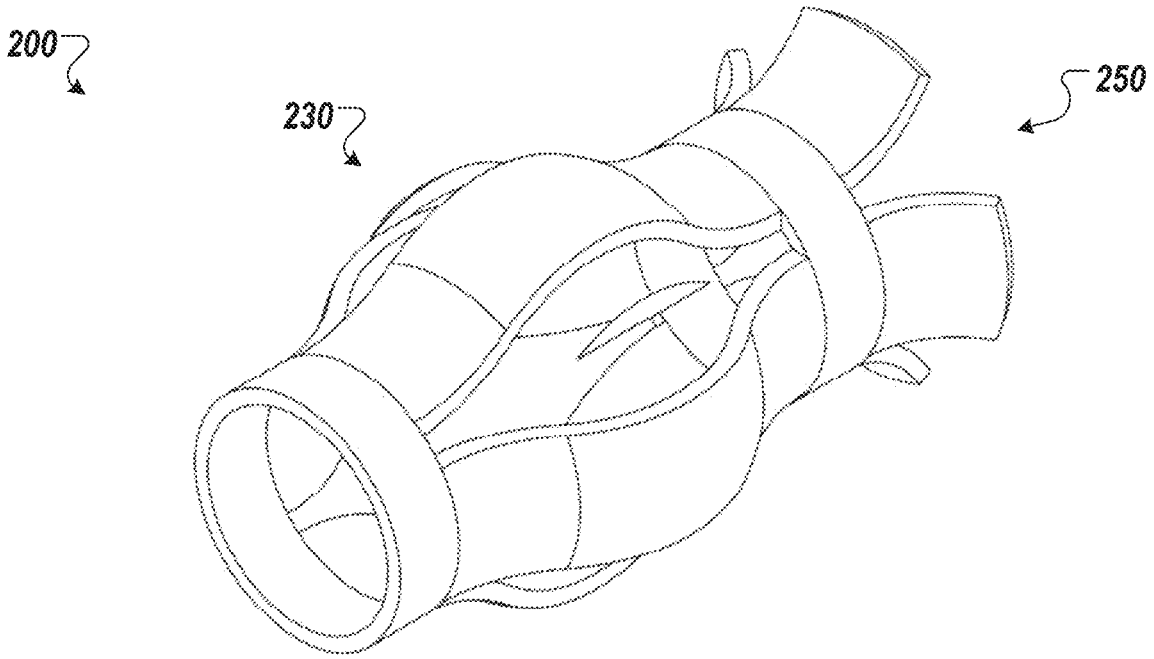
FIG. 8A shows an isometric view of a centralizer device, according to one implementation.
Figure 8B:
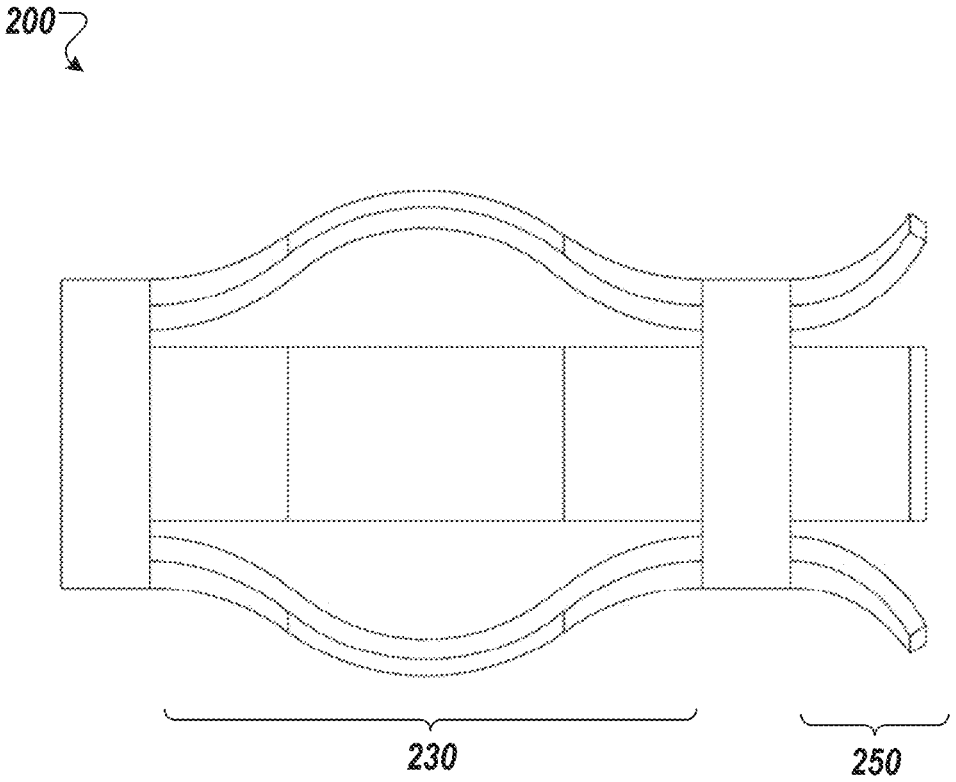
FIG. 8B shows a side view of the centralizer device of FIG. 8A.

FIG. 8A and FIG. 8B, referenced above, show a centralizer device 200 having a tail section 250 with a tail diameter that is less than a body diameter of the body section 230. The centralizer device 200 is otherwise similar to the centralizer device 100.

Figure 9A:
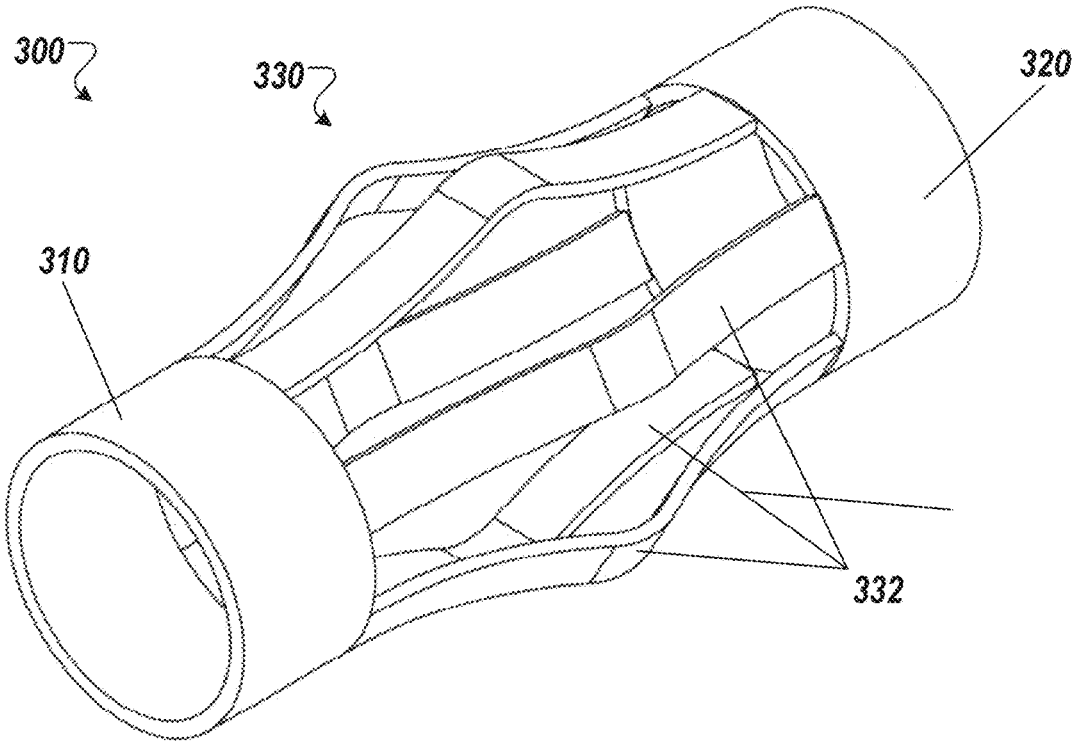
FIG. 9A shows an isometric view of a centralizer device, according to one implementation.
Figure 9B:
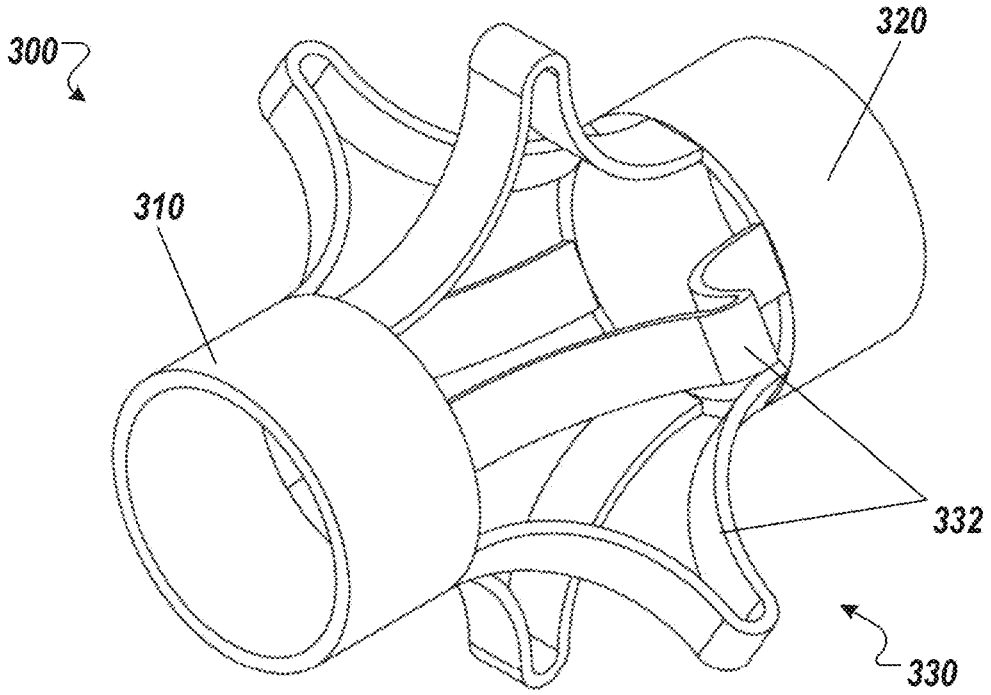
FIG. 9B shows an isometric view of the centralizer device of FIG. 9A in an expanded or "radial" configuration.

FIG. 9A and FIG. 9B show a centralizer device 300 having a first collar 310, a second collar 320, and a body 330. The body includes a plurality of flexible body members 332 extending between the first collar 310 and the second collar 320. The flexible body members 332 are movable between a longitudinal configuration (shown in FIG. 9A) and a radial configuration (shown in FIG. 9B).

In the longitudinal configuration, the flexible body members 332 are expanded such that the first collar 310 is spaced apart from the second collar 320 by a maximum distance. The longitudinal configuration is a minimal diameter condition for the centralizer device 300, and it may be used upon insertion of the centralizer device 300 into a hole.

In the radial configuration, the flexible body members 332 are contracted towards each other and expanded radially outward. The first collar 310 and the second collar 320 are spaced apart by a minimal distance. The radial configuration is a maximal diameter condition for the centralizer device 300, and it may be used to resist extraction of the centralizer device 300 (e.g., once the centralizer device 300 is in place in the hole).

Figure 10A:
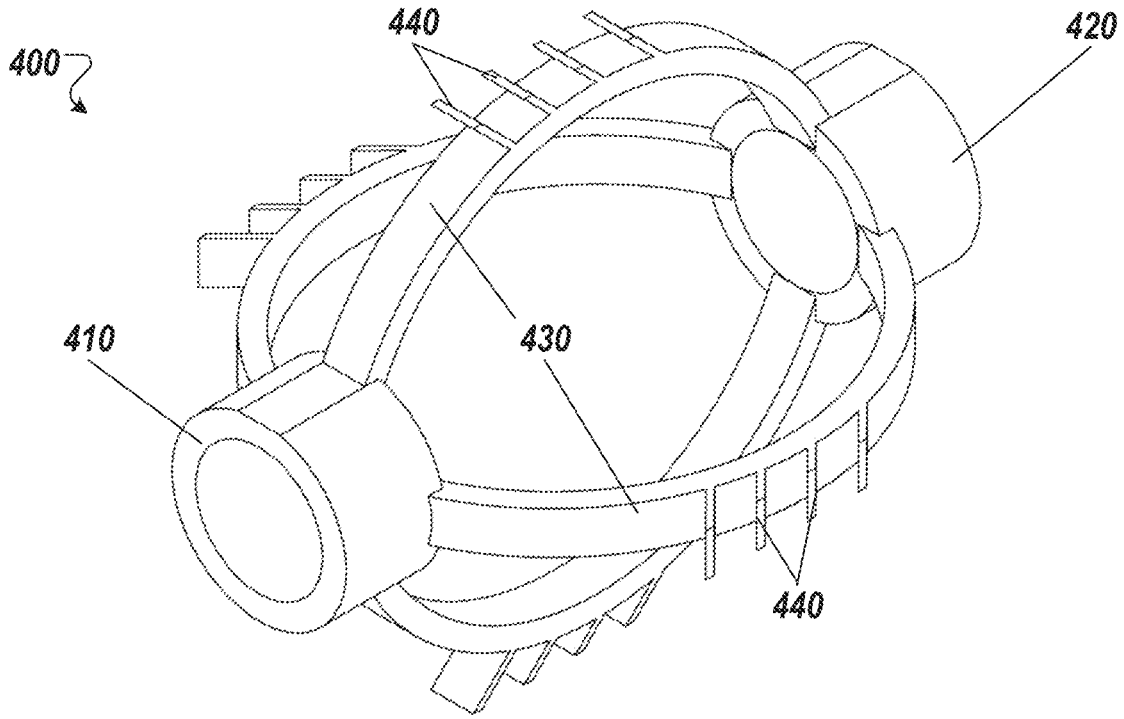
FIG. 10A shows an isometric view of a centralizer device, according to one implementation.
Figure 10B:
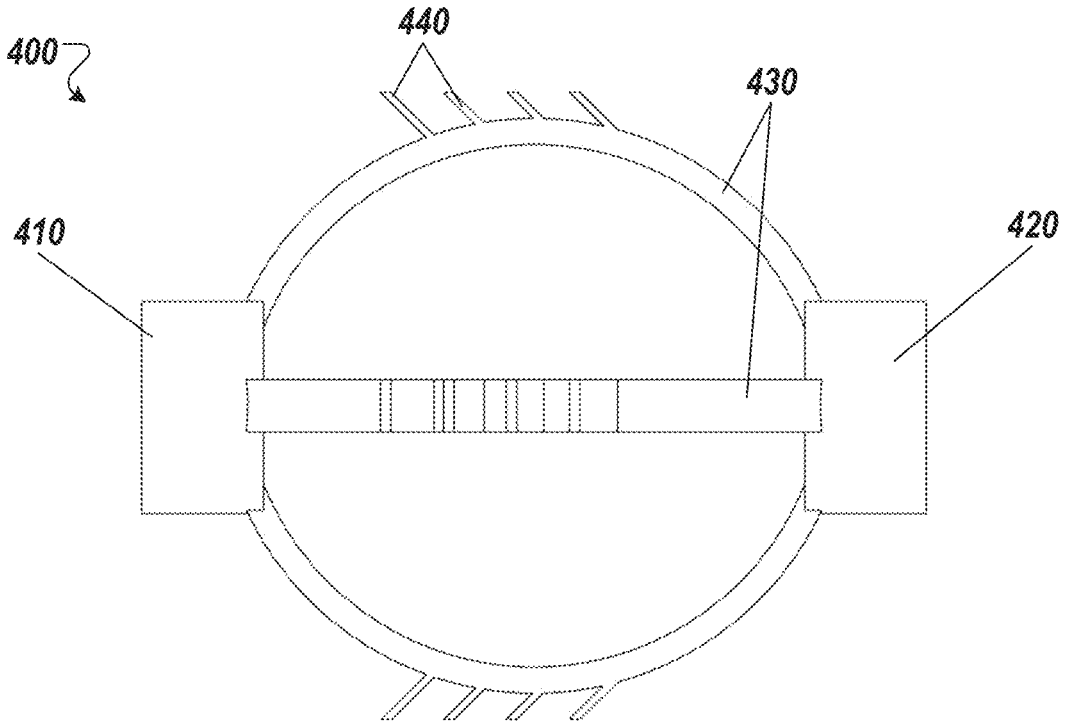
FIG. 10B shows a side view of the centralizer device of FIG. 10A.

FIG. 10A and FIG. 10B show a centralizer device 400 having a first collar 410, a second collar 420, and a plurality of body members 430 extending between the first collar 410 and the second collar 420. The body members 430 may be flexible or rigid members. Each of the body members 430 include a plurality of fins 440 extending from an outer surface of the body members 430 at an angle. The fins 440 are configured to resist movement of the centralizer device 400 in a direction (e.g., an extraction or up-hole direction during installation). The fins 440 may be flexible or rigid members. The fins 440 engage the surrounding substrate in a manner similar to that described in FIGS. 7A-7D.

Figure 11A:
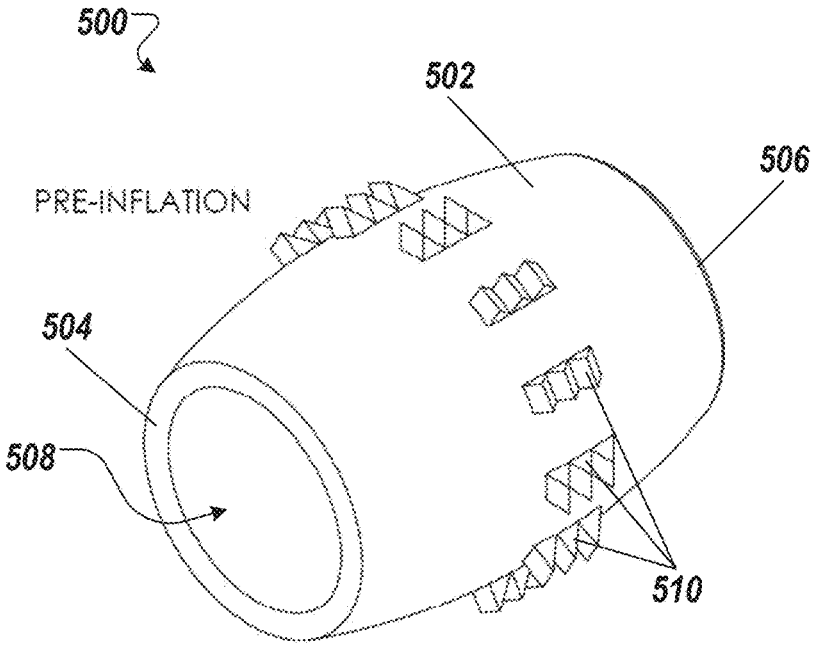
FIG. 11A shows an isometric view of an inflatable centralizer device, according to one implementation.
Figure 11B:
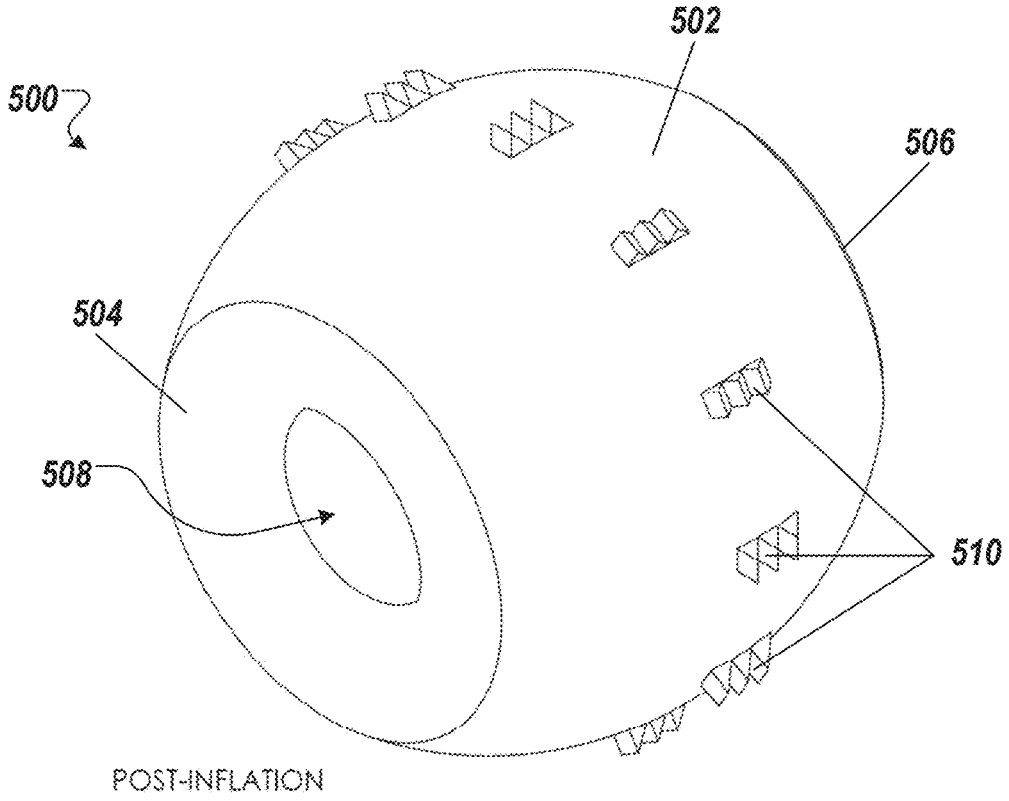
FIG. 11B shows an inflated configuration of the centralizer device of FIG. 11A.

FIG. 11A and FIG. 11B show a centralizer device 500 which is an inflatable centralizer device. The centralizer device includes a main body 502 extending between a first end 504 and a second end 506. A longitudinal channel 508 extends through the centralizer device 500 from the first end 504 to the second end 506. A plurality of fins 510 are arranged on the outer surface of the main body 502 at an angle. The plurality of fins 510 are configured to resist movement of the centralizer device 500 in a direction (e.g., extraction or up-hole direction during installation). The plurality of fins 510 may be flexible or rigid members.

The main body 502 generally defines an internal bladder configured to couple to a fluid source. The centralizer device 500 in FIG. 11A is in the pre-inflation configuration wherein the internal bladder is not inflated. Once a fluid (e.g., liquid or compressed air) is pumped into the internal bladder, the centralizer device 500 expands to an inflated configuration shown in FIG. 11B. The centralizer device 500 may be inflated once it has been installed in a desired location in an underground hole. The inflated size of the centralizer device 500, along with the plurality of fins 510, resist movement of the centralizer device 500.

Figure 12A:
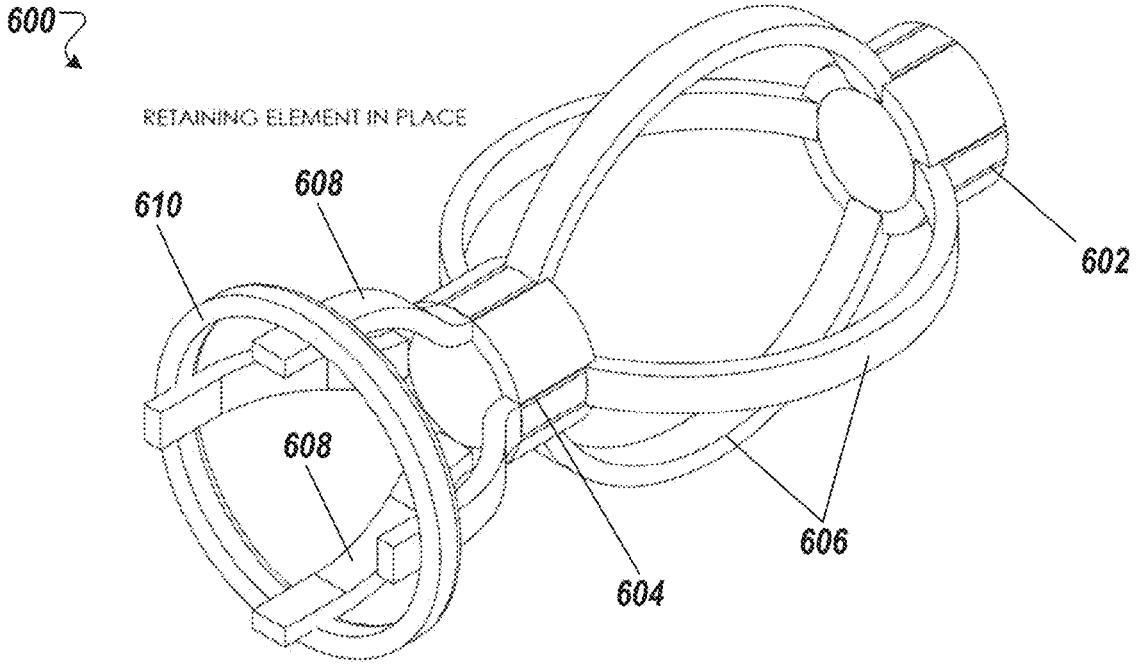
FIG. 12A shows an isometric view of a centralizer device in the retained configuration, according to one implementation.
Figure 12B:
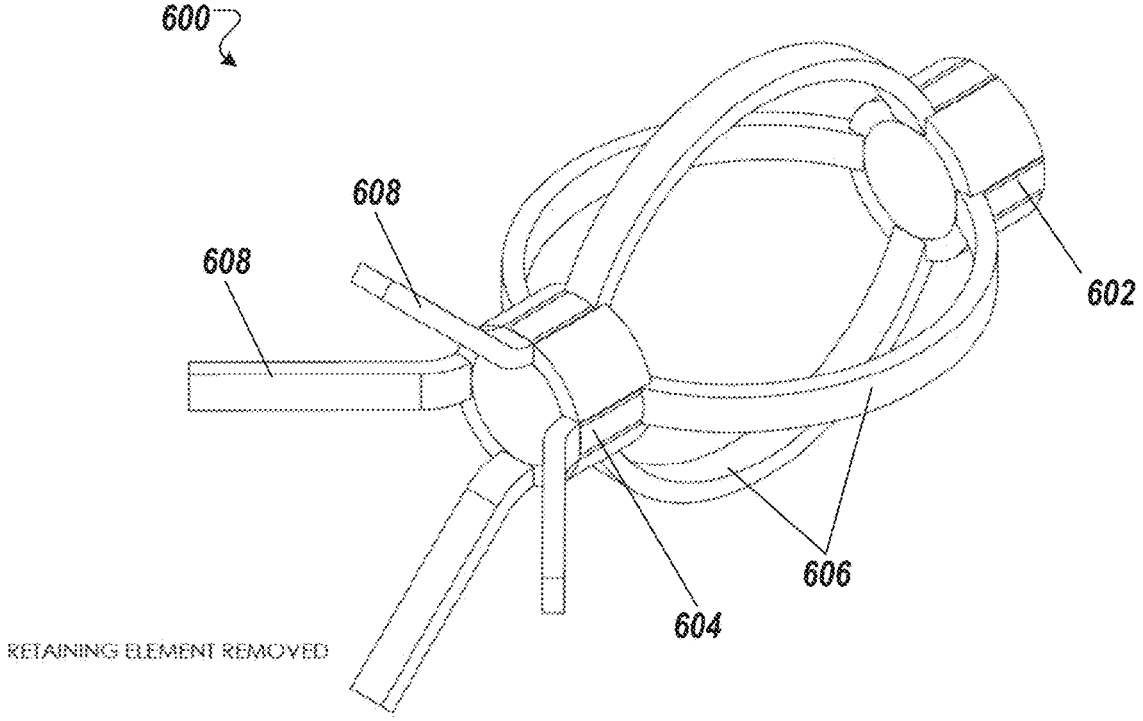
FIG. 12B shows the centralizer device of FIG. 12A in the expanded configuration.

FIG. 12A and FIG. 12B show a centralizer device 600 having a first collar 602, a second collar 604, a plurality of body members 606 extending between the first collar 602 and the second collar 604, and a tail section 608 extending from the second collar 604. In general, the structure of the centralizer device 600 is similar to the centralizer device 100 of FIGS. 1A-1B. However, the tail section 608 of the centralizer device 600 is biased radially outward.

A retaining ring 610 is pre-installed around the tail section 608 to retain the tail section 608 radially inward (e.g., during installation), as shown in FIG. 12A. Once the centralizer device 600 is placed in the desired location, the retaining ring 610 may be removed, and the tail section 608 springs radially outward to engage the surrounding substrate and generally resist movement, as shown in FIG. 12B.

Configuration of Certain Implementations

The construction and arrangement of the systems and methods as shown in the various implementations are illustrative only. Although only a few implementations have been described in detail in this disclosure, many modifications are possible (e.g., variations in sizes, dimensions, structures, shapes, and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative implementations. Other substitutions, modifications, changes, and omissions may be made in the design, operating conditions, and arrangement of the implementations without departing from the scope of the present disclosure.

Although the figures show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps.

It is to be understood that the methods and systems are not limited to specific synthetic methods, specific components, or to particular compositions. It is also to be understood that the terminology used herein is for the purpose of describing particular implementations only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another implementation includes from the one particular value and/or to the other particular value. Similarly, when values are expressed as approximations, by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not. Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal implementation. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific implementation or combination of implementations of the disclosed methods.

What is claimed is:

1. An in-ground mechanical bow spring centralizer device, the centralizer device comprising:

a body collar extending circumferentially around a central axis and defining a longitudinal channel, the central axis extending from an up-hole direction of the centralizer device towards a downhole direction of the centralizer device;

a tail collar extending circumferentially around the central axis to further define the longitudinal channel, the tail collar spaced apart from the body collar in the up-hole direction of the centralizer device;

a body extending between the body collar and the tail collar, the body including a first portion coupled to the body collar, a second portion coupled to the tail collar, and a bow portion coupled to and between the first portion and the second portion, the bow portion extending radially outward from the central axis to define at least one apex, wherein the body further defines at least one opening; and a tail extending (i) longitudinally from the tail collar or the body collar and (ii) radially outward from the central axis, the tail comprising a tail tip at a distal end thereof, wherein the tail tip is angled such that (i) during movement of the centralizer device in the downhole direction of a hole, the tail tip does not penetrate a surrounding substrate of the hole, and (ii) during movement of the centralizer device in the up-hole direction of the hole, the tail tip penetrates the surrounding substrate to resist movement in the up-hole direction.

2. The centralizer device of claim 1, wherein the tail extends longitudinally from the tail collar in the up-hole direction.

3. The centralizer device of claim 1, wherein the tail tip extends further radially outward than the at least one apex of the bow portion of the body.

4. The centralizer device of claim 1, wherein the tail tip extends radially outward from the central axis the same distance as the at least one apex of the bow portion of the body extends radially outward from the central axis.

5. The centralizer device of claim 1, wherein the at least one apex of the bow portion of the body extends further radially outward than the tail tip.

6. The centralizer device of claim 1, wherein the body comprises a plurality of body sections, including a first body section and a second body section.

7. The centralizer device of claim 6, wherein the first body section and the second body section are equally circumferentially spaced apart from each other.

8. The centralizer device of claim 1, wherein the tail comprises a plurality of tail sections, including a first tail section and a second tail section that are equally circumferentially spaced apart from each other.

9. The centralizer device of claim 1, wherein the body and the tail are flexible such that one or both of the body and the tail are radially compressible and expandable during operation.

10. The centralizer device of claim 1, wherein the tail tip is flexible and, when penetrating the surrounding substrate, the tail tip flexes to move (i) radially outward from the central axis and (ii) longitudinally toward the downhole direction with respect to the tail collar.

11. The centralizer device of claim 1, wherein the centralizer device is configured to allow longitudinal translation and rotational translation of a centralized object that is disposed within the longitudinal channel relative to the centralizer device.

12. A system comprising: an in-ground mechanical bow spring centralizer device, the centralizer device comprising:

a body collar extending circumferentially around a central axis and defining a longitudinal channel, the central axis extending from an up-hole direction of the centralizer device towards a downhole direction of the centralizer device;

a tail collar extending circumferentially around the central axis to further define the longitudinal channel, the tail collar spaced apart from the body collar in the up-hole direction of the centralizer device;

a body extending between the body collar and the tail collar, the body including a first portion coupled to the body collar, a second portion coupled to the tail collar, and a bow portion coupled to and between the first portion and the second portion, the bow portion extending radially outward from the central axis to define at least one apex, wherein the body further defines at least one opening; and a tail extending (i) longitudinally from the tail collar and (ii) radially outward from the central axis, the tail comprising a tail tip at a distal end thereof, wherein the tail tip is angled such that (i) during movement of the centralizer device in the downhole direction of a hole, the tail tip does not penetrate a surrounding substrate of the hole, and (ii) during movement of the centralizer device in the up-hole direction of the hole, the tail tip penetrates the surrounding substrate to resist movement in the up-hole direction;

and an installation tube comprising an outer tube surface and a catch disposed on and protruding from the outer tube surface, wherein the catch engages with one or both of the body collar and the tail collar.

13. The system of claim 12, wherein the catch is a first catch, the installation tube further comprising a second catch spaced apart from the first catch.

14. The system of claim 13, wherein the first catch engages with the up-hole end of the tail collar through a tail opening defined by the tail, and the second catch extends through the at least one opening of the body to engage with the up-hole end of the body collar.

15. The system of claim 14, wherein, in an advancing configuration, an extent of the second catch engaging the body collar is disposed outside of the longitudinal channel and the installation tube is disposed inside the longitudinal channel radially adjacent to either the tail collar, the body collar, or the body.

16. The system of claim 15, wherein, in a retracting configuration, the second catch is disposed inside the longitudinal channel and does not contact nor engage with the tail collar, the body collar, or the body, wherein the installation tube is free to retract out of the centralizer device.

17. The system of claim 12, wherein the installation tube is disposed within the longitudinal channel of the centralizer device, and both the centralizer device and the installation tube are installed in an underground hole.

18. The system of claim 17, wherein the centralizer device is configured to use spring tension to resist deviation from an axis of the underground hole by applying stress to an exterior wall of the underground hole and/or penetrating a substrate of the underground hole.

19. The system of claim 18, wherein the catch of the installation tube engaging with the centralizer device applies a downhole force to the centralizer device to facilitate installation.

* * * * *